United States Patent [19]

Olivé et al.

[11] 4,423,113

[45] Dec. 27, 1983

[54] ZIRCONIUM OXIDE COATED NYLON FIBERS

[75] Inventors: Salvador Olivé; Gisela Olive, both of Cantonment, Fla.

[73] Assignee: Monsanto Company, St. Louis, Mo.

[21] Appl. No.: 360,714

[22] Filed: Mar. 22, 1982

[51] Int. Cl.[3] ..... D02G 3/00

[52] U.S. Cl. ..... 428/389; 428/395; 427/372.2; 427/376.1; 427/384

[58] Field of Search ..... 428/384, 389, 375, 395, 428/379; 252/8.8; 8/115.6; 427/376.2, 376.1, 372.2, 394, 384

[56] References Cited

U.S. PATENT DOCUMENTS

| | | | |
|---|---|---|---|
| 3,293,178 | 12/1966 | MacDonald et al. | 252/8.8 |
| 3,592,684 | 7/1971 | Smith | 428/272 X |
| 3,671,292 | 6/1972 | Hirshfeld et al. | 428/389 |

*Primary Examiner*—Lorraine T. Kendell

*Attorney, Agent, or Firm*—John W. Whisler

[57] ABSTRACT

Nylon fibers having a soil-resistant coating comprising the reaction product of polymeric zirconium oxide and hydrocarboxylic acid or salt thereof, for example, sodium lactate. The coating is more durable than if the acid or salt thereof are omitted therefrom.

4 Claims, No Drawings

ZIRCONIUM OXIDE COATED NYLON FIBERS

BACKGROUND OF THE INVENTION

A. Field of the Invention

The invention relates to nylon fibers having a soil-resistant coating comprising the reaction product of polymeric zirconium oxide and a hydroxycarboxylic acid or salt thereof.

B. Description of the Prior Art

Fibers coated with a soil-resistant coating of polymeric zirconium oxide are disclosed in U.S. Pat. No. 3,592,684. The coated fibers are obtained by treating fibers with an aqueous solution of a water-soluble salt of zirconium or hydrous zirconia and, then, drying the fibers to remove the water and leave a coating of polymeric zirconium oxide, $(ZrO_2)_n$, adhered to the fiber surface; one or more of the oxygen atoms of the polymeric zirconium oxide may be replaced by a $OH^+$ radical. The polymeric zirconium oxide coating imparts soil resistant properties to the fibers and fabrics, such as carpeting, made from the fibers. Unfortunately, the adherence of the coating to the fiber surface is relatively weak. Consequently, when the coated fibers are used for carpet pile, significant amounts of the coating are removed from the fiber surface during normal carpet dyeing operations and also during normal wear and cleaning of the carpet.

SUMMARY OF THE INVENTION

In accordance with the present invention the adherence of the polymeric zirconium oxide coating to fiber surfaces is improved by modifying the coating to comprise the reaction product of polymeric zirconium oxide and a hydroxycarboxylic acid (or salt thereof). The presence of the hydroxycarboxylic acid in some way improves the adherence of the zirconium oxide to the fiber surface. The coated fibers of the present invention have good soil-resistant properties and the adherence of the coating to the fiber surface is greater than if the hydroxycarboxylic acid were omitted.

PREFERRED EMBODIMENTS OF THE INVENTION

The coated fibers of the invention are conveniently prepared by treating fibers with an aqueous solution of a water-soluble salt of zirconium or hydrous zirconia and a hydroxycarboxylic acid or a salt thereof. The fibers are then dried leaving a coating comprising the reaction product of $(ZrO_2)_n$ and the hydroxycarboxylic acid. The useful range for the ratio of acid to zirconium in the aqueous solution (expressed as moles of acid to gram atoms of Zr) is 0.1 to 10. Generally, sufficient water-soluble zirconium salt or hydrous zirconia is present to provide fibers coated with from 0.01 to 1.0% by weight of zirconium, based on the weight of fiber, i.e., 100 to 10,000 ppm Zr. The coating may be applied to the fibers from an aqueous immersion bath, spin finish or other suitable means.

Suitable water-soluble zirconium salts that may be used in practicing the invention include zirconium acetate, zirconium bromide, zirconium oxalate and the like.

Suitable hydroxycarboxylic acids that may be used in practicing the invention include lactic acid, citric acid, tartaric acid and salts thereof and, in particular, the sodium salts of the acids.

Fibers that may be coated to produce the coated fibers of the invention may be in the form of continuous filament yarns or staple yarns and may be composed of any polymeric substance, such as nylon. Nylon coated fibers of the invention are particularly useful in pile fabric applications (e.g. carpeting) where soil resistant properties and strong adherence (i.e. durability) of the coating to the fiber surface are important.

According to one embodiment of the invention the coated fibers of the invention are heat treated to further improve the adherency of the coating. The heat treatment consists of heating the coated fibers at a temperature for a period of time sufficient to improve the adherence of the coating without causing deterioration of the fiber properties, for example, at 150° C. for 10 minutes. Higher temperatures and shorter periods of time may be used and vice versa.

The following examples are given to further illustrate the invention. In the example, parts and percentages are by weight unless otherwise specified.

EXAMPLE

Experiments were conducted which show that coated fibers of the present invention (i.e. fibers coated with a coating comprising the reaction product of polymeric zirconium oxide and a hydroxycarboxylic acid) have better retention of the zirconium coating under carpet dyeing conditions that corresponding fibers from which the hydroxycarboxylic acid is omitted. Zirconium Retention is a measure of the adherence of the coating to the fiber surface.

In the experiments skeins of continuous filament nylon 66 yarns were prepared and individually treated in the following manner: the skein was first immersed in an aqueous solution of zirconium acetate or of zirconium acetate and a hydroxycarboxylic acid, or the sodium salt thereof, for the period of time indicated in the Tables below; then dried in a vacuum oven over night, blank-dyed in a universal buffer (75 min. at 100° C.), rinsed, dried and, finally analyzed to determine the amount of zirconium retained on the surface of the yarn. A second skein was treated in the same manner except that the blank-dyeing, rinsing and drying steps were omitted.

The following aqueous solutions were used in the experiments:

Solution A: An aqueous solution of zirconium acetate containing 1.8 gram atom of zirconium per kg of aqueous solution.

Solution B: An aqueous solution of zirconium acetate containing 0.1 gram atom of Zr/kg of solution was prepared by diluting a portion of Solution A with water.

Solution C: Solution C was prepared by adding 0.1 mole of lactic acid 85% (10.6 g) dropwise to 55.5 g of Solution A and then diluting the resulting solution to 1 kg with water.

Solution D: Solution D was prepared by diluting 0.04 mole of lactic acid 85% (4.24 g) to 50 g with water and then adding Solution B dropwise to this solution until 0.01 g atom of Zr had been added.

Solution E: Solution E was prepared by mixing 0.01 mole of citric acid (1.92 g) in 30 ml water with 31.5 g of 1 N NaOH to provide a clear solution (63.4 g) at a pH of 7.1. To this solution 5.55 g of Solution A diluted to 36.6 g with water (0.01 g atom of Zr) was added dropwise to give 100 g of Solution E (pH=6.17).

Solution F: Solution F was prepared by mixing 0.01 mole of 85% lactic acid (1.06 g) in 30 ml water with 8.9 g of 1 N NaOH to provide 39.9 g of solution at a pH of 7.1. To this solution 5.55 g of Solution A diluted to 60.1 g with water were added dropwise to give Solution F (pH=5.17).

Solution G: Solution G was prepared by mixing 0.01 mole of tartaric acid (1.50 g) in 30 ml of water with 21.4 g of 1 N NaOH to provide 52.9 g of solution at a pH of 7.1. To this solution 5.55 g of Solution A diluted to 47.1 g with water were added dropwise to give Solution G at a pH of 5.24.

Blank Dyeing Solution: A blank dyeing solution was prepared by dissolving $10^{-2}$ moles of each phosphoric acid, boric acid and acetic acid in water and, then, adjusting the pH to 4.0 with NaOH and, finally, diluting with water to a total volume of 1000 ml.

The skeins were each prepared from continuous filament nylon 66 yarn composed of 68 filaments and having a total denier of 1313. Each skein weighed 15 g and was washed twice with boiling methanol for two hours to remove all spin finishes and, then, subjected to centrifugation and dried under vacuum.

Zr analysis was performed on the yarns by X-ray fluoroscence spectroscopy.

Table I below shows that the retention of the zirconium coating through dyeing (Zr Retention) is low in the absence of a hydroxycarboxylic acid (Runs 1–4), but is markedly improved in the presence of lactic acid (Runs 5–11). The % Zr Retention increases as the ratio of lactic acid/Zr increases (compare Runs 6,8 and 9). As shown by the results of Run 10, the Zr Retention is further improved by a heat treatment of the fiber prior to dyeing (blank-dyeing).

TABLE I

| Run | Solution | Acid | Additive (Mole/g Atom | Immersion Time | Blank dyed | Zr (ppm) | % Zr Retention |
|---|---|---|---|---|---|---|---|
| 1 | B | — | 0 | 1 hour | No | 632 | — |
| 2 | B | — | 0 | 1 hour | Yes | 99 | 15.7 |
| 3 | B | — | 0 | 24 hours | No | 637 | — |
| 4 | B | — | 0 | 24 hours | Yes | 124 | 19.5 |
| 5 | C | lactic acid | 1 | 1 min | No | 750 | — |
| 6 | C | lactic acid | 1 | 1 min | Yes | 183 | 24.4 |
| 7 | C | lactic acid | 1 | 1 hour | No | 600 | — |
| 8 | C | lactic acid | 1 | 1 hour | Yes | 266 | 44.3 |
| 9 | D | lactic acid | 4 | 1 hour | Yes | 376 | 62.7 |
| 10 | C | lactic acid | 1 | 1 hour | No* | 511 | — |
| 11 | C | lactic acid | 1 | 1 hour | Yes* | 363 | 71.0 |

*Fiber heated for 10 min at 150° C., prior to blank-dyeing, or before analysis, if not blank-dyed.

Table II below shows that the Zr Retention through dyeing can also be improved by using sodium salts of hydroxycarboxylic acids. In this instance, the skeins were immersed in the solutions for a period of one hour. The sodium lactate is even more effective in retaining the zirconium coating than the lactic acid and is more effective than the other two salts.

TABLE II

| Run | Solution | Solution Acid | Additive/ Zr (Mole/g Atom) | Blank dyed | Zr (ppm) | % Zr Retention |
|---|---|---|---|---|---|---|
| 12 | B | — | 0 | No | 632 | — |
| 13 | B | — | 0 | Yes | 99 | 15.7 |
| 14 | E | Na-citrate | 1 | Yes | 159 | 25.1 |
| 15 | F | Na-tartrate | 1 | Yes | 227 | 35.9 |
| 16 | G | Na-lactate | 1 | Yes | 513 | 81.2 |

What is claimed is:

1. A nylon fiber coated with a composition consisting essentially of the reaction product of polymeric zirconium oxide and a hydroxycarboxylic acid or salt thereof.

2. The fiber of claim 1 wherein the fiber is in the form of a continuous filament yarn.

3. The fiber of claim 2 wherein the hydroxycarboxylic acid or salt thereof is an acid selected from lactic acid, citric acid, tartaric acid and the sodium salts thereof.

4. A nylon fiber coated with a composition consisting essentially of the reaction product of polymeric zirconium oxide and sodium lactate.

* * * * *